US005884965A

United States Patent [19]

Allen

[11] Patent Number: 5,884,965

[45] Date of Patent: Mar. 23, 1999

[54] CONVERTIBLE CHAIR

[75] Inventor: Dillis V. Allen, Elgin, Ill.

[73] Assignee: Vardon Golf Company, Inc., Elk Grove Village, Ill.

[21] Appl. No.: 863,464

[22] Filed: May 27, 1997

[51] Int. Cl.[6] ..... A47C 13/00

[52] U.S. Cl. ..... 297/3; 297/452.19; 5/656; 5/900.5

[58] Field of Search ..... 297/1, 3, 270.3, 297/452.19, 118; 5/110, 112, 632, 655, 656, 731, 900.5

[56] References Cited

U.S. PATENT DOCUMENTS

| | | | |
|---|---|---|---|
| 2,219,624 | 10/1940 | Dixon | 472/110 X |
| 2,651,058 | 9/1953 | Almoslino | 297/270.3 X |
| 3,099,477 | 7/1963 | O'Herron | 297/1 |
| 3,650,563 | 3/1972 | Hansson et al. | 297/18 |
| 3,972,559 | 8/1976 | Anacker | 297/1 |
| 4,241,949 | 12/1980 | Parker | 297/3 |

FOREIGN PATENT DOCUMENTS

| | | | |
|---|---|---|---|
| 672970 | 11/1965 | Belgium | 297/1 |
| 3338 | 1/1866 | United Kingdom | 297/1 |

*Primary Examiner*—Peter R. Brown
*Attorney, Agent, or Firm*—Dillis V. Allen, Esq.

[57] ABSTRACT

A pool or beach chair that when flipped over converts to a supine body support for back tanning consisting of an arcuate tubular body support shorter in length than an average adult female wrapped with fabric or elastic bands on both sides. Tubular legs on one side support the body support in the chair mode and tubular loops on the other side form chair arms in the arm mode and ground supports for one end of the body support in the inverted supine mode. The other end of the body support is supported in the inverted supine mode by a pair of smaller tubular loops at the head end of the body support that also serve as handles for moving the chair or flipping it over to the inverted supine mode or position.

12 Claims, 1 Drawing Sheet

CONVERTIBLE CHAIR

BACKGROUND OF THE INVENTION

There is a significant body of prior art suggesting basic chair structures that can be manipulated to achieve some other function such as a lounging chaise. The following is a list of art that exemplifies the collection.

The O'Herron, U.S. Pat. No. 3,099,477, which issued on Jul. 30, 1963, shows a pair of parallel, spaced ellipsoid tubes that form the legs and arm rests for a chair seat and back. The chair can be flipped over to its FIG. 10 position when the chair back forms a child's slide.

The Austrian Patentschrift No. 38,223 has similar spaced parallel ellipsoid chair sides that can be flipped over to convert the device from a rocking chair to a stationary chair in FIG. 2. However, it requires movable parts to achieve its lounging mode and cannot be used for back tanning.

The True, U.S. Pat. No. 191,733, issued on Jun. 5, 1977, shows a convertible chair that also requires moving parts to effect the lounge mode shown in FIG. 4.

The Knight, U.S. Pat. No. 4,164,356, issued on Aug. 14, 1979, is typical of chairs that pivot up about 90 degrees to reverse the head and leg portions of the chair. This technique limits the significance of mode change from one position to another. That is, the modes are too similar to one another.

A chair convertible to an easy chair is shown in the Martinez, U.S. Pat. No. 4,580,834, issued on Apr. 8, 1986. The chair back and the rear legs form an arcuate easy chair when the upright chair is rotated about 90 degrees. This design will not work in an inverted supine body position.

Also, many of these prior convertible chairs cannot be stacked, which is a requirement for crowded resort pool areas.

It is a primary object of the present invention to ameliorate the problems discussed above in the prior art and to provide an improved compact pool or beach chair that converts to an inverted supine body rest when rotated about 150 degrees.

SUMMARY OF THE PRESENT INVENTION

It is a primary object of the present invention to provide a compact pool or beach chair that converts to an inverted supine body rest when rotated or turned over about 150 degrees.

Toward this end this pool or beach chair, when flipped over, converts to a supine body support for back tanning consisting of an arcuate tubular body support shorter in length than an average adult female wrapped with fabric or elastic bands on both sides. Tubular legs on one side support the body support in the chair mode and tubular loops on the other side form chair arms in the chair mode and ground supports for one end of the body support in the supine mode. The other end of the body support is supported in the inverted supine mode by a pair of smaller tubular loops at the head end of the body support that also serve as handles for moving the chair or flipping it over to the supine mode or position.

DETAILED DESCRIPTION OF THE PREFERRED EMBODIMENT

Figures 1, 2:
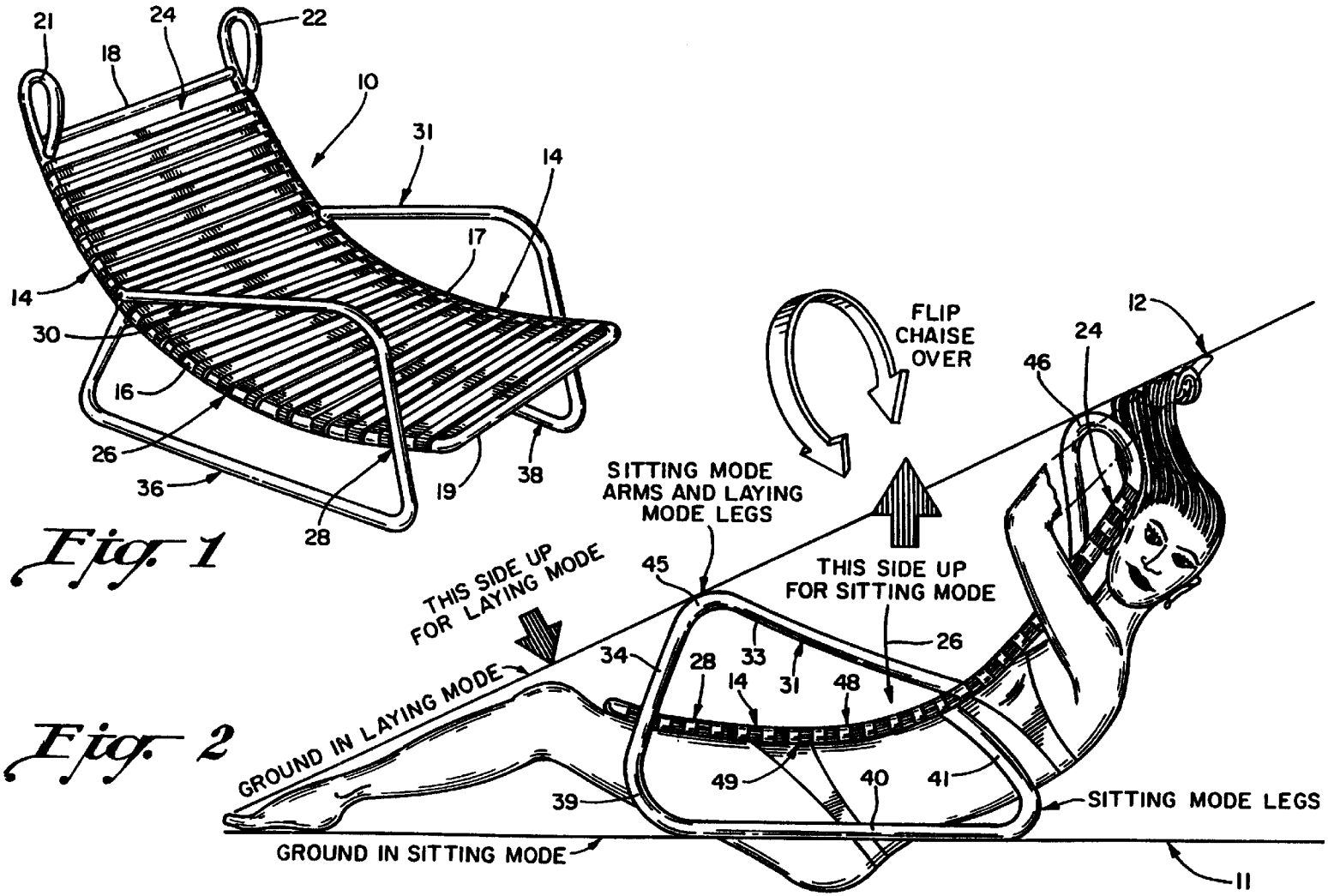
FIG. 1 is a perspective view of the present pool-beach chair.
FIG. 2 is an enlarged side view of the pool-beach chair positioned in the chair but which shows the human form positioned in an inverted supine position.

When one views the pool-beach chair 10 along the horizontal line 11 in FIG. 2, it is in the chair mode and when one rotates FIG. 2 about 150 degrees so line 12 is the ground, chair 10 is in the inverted supine mode and the human figure shown is in a position particularly suitable for sun tanning the back and the rear surfaces of the legs.

Short or small chairs have become increasingly popular at luxury high grade hotels at the pool because they take up less room not only when stacked or during storage, but when the pool guests are sunning, they occupy considerably less space than a full size chaise. The chair 10 has about 15% larger external dimensions than the conventional short pool chairs although the prior art designs are somewhat more upright and of course not convertible.

It should also be understood that FIG. 2 is drawn approximately to a 1:6 scale; that is, 1 inch equals 6 inches, and the human model depicted is about 5 foot 10 inches tall and to that same scale.

As seen in FIG. 1, the chair 10 includes a body support 14 that includes an arcuate generally rectangular metal tubular frame including arcuate side rails 16 and 17 interconnected by a head cross rail 18 and a leg cross rail 19 all integrally formed by bending and welding.

The side rails 16 and 17 have head extension loops 21 and 22 that serve as handles for manipulating the chair 10 and also for spacing head portion 24 above the ground line 12 about 8 to 10 inches as shown in FIG. 2.

An important aspect of the present invention is that the same portions of the body support 14 function to support about the same portions of the human body in both modes. That is, head portion 24 supports the head and thorax in the inverted supine or laying mode, and supports the back or head and back in the chair mode. Similarly, center portion 26 of the body support 14 supports the pelvic or buttocks areas in both modes. And lastly, the leg portion 28 supports the leg thighs in both modes.

Chair 10 has tubular arm rests 30 and 31 including a forwardly extending portion 33 welded at its rear to the side rails 16 and 17 and angling upwardly in the chair mode about 20 degrees. Portion 33 bends downwardly and forwardly into portion 34 at about 20 degrees forwardly of a vertical line where it is welded to the side rails 16 and 17.

Chair arms 30 and 31 function also to space the leg portion 28 of the body support 14 about 4 to 8 inches from the ground 12 in the supine mode.

Chair 10 also has legs 36 and 38 that each include a downwardly and forwardly extending portion 39 integral and in line with arm portion 34 that bends gently rearwardly into a straight rearwardly extending portion 40 that engages ground 11 in the chair mode. Portion 40 bends upwardly and forwardly at its rear into portion 41 which angles about 45 degrees forwardly to the side rails 16 and 17 where it is welded thereto.

Legs 36 and 38 support the body support 14 in the chair mode so the end of leg portion 28 is about 6 to 12 inches off ground 11.

The body support 14 is formed on a radius of about 30 inches and has a length along ground line 12 of about 42 inches.

The arms 30 and 31 and the loops 21 and 22 define four ground engaging surfaces 45 and 46 lying in a common plane that support chair 10 on ground 12 in the supine mode.

The body support 14 also includes a first resilient body engaging surface 48 for the chair mode and a second body engaging resilient surface 49 for the supine mode spaced from one another by the diameter of the tubular body support frame. Surfaces 48 and 49 can be formed using known elastomeric cushion technology except both sides of the frame are wrapped in the present chair.

Ground line 12 forms an angle of about 30 degrees with ground line 11, so the user grasps one of the handles 21,22 in the chair mode and rotates the chair counterclockwise in FIG. 2 (forwardly) about 150 degrees to place the chair in the supine mode.

The arms 30 and 31 are co-planar with the legs 36 and 38 and together they diverge from top to bottom outwardly a distance slightly greater than the diameter of their tubular construction, so the chairs may be stacked upon one another, a capability not found in most convertible chairs.

What is claimed is:

1. A convertible chaise, comprising: a body support including a first portion for supporting on one side of the body support a human head and back in a back laying or sitting position, and for supporting on the other side of the body support the human head and thorax in a frontal laying position, said body support having a second portion angular related to said first portion, and adjacent and attached to the first portion for supporting on the one side of the body support the human buttocks and legs in the back laying or sitting position, and for supporting on the other side of the body support the pelvis and legs in the frontal laying position, a first support non-movably attached to the body support for supporting the body support on a horizontal surface in a fixed position without rocking in the back laying or sitting position, and a second support non-movably attached to the body support for supporting the body support on a horizontal surface in a fixed position without rocking in the frontal laying position, said body support being invertible from the back laying or sitting position to the frontal laying position.

2. A convertible chaise, comprising: a body support including a first portion for supporting on one side of the body support a human head and back in a back laying or sitting position, and for supporting on the other side of the body support the human head and thorax in a frontal laying position, said body support having a second portion adjacent and attached to the first for supporting on the one side of the body support the human buttocks and legs in the back laying or sitting position, and for supporting on the other side of the body support the pelvis and legs in the frontal laying position, a first support non-movably attached to the body support for supporting the body support in a fixed position on a horizontal surface without rocking in the frontal laying position, and a second support non-movably attached to the body support for supporting the body support in a fixed position on a horizontal surface without rocking in the frontal laying position, said first portion and said second portion being gently curved when they are attached to one another to comfortably support the thorax in the frontal laying position, said body supporting being invertible from the back laying or sitting position to the frontal laying position.

3. A convertible chaise that changes modes by flipping the chaise approximately 180 degrees about a horizontal axis, comprising: a body support having a first side for supporting a human form in a back laying or sitting position and an opposite second side for supporting the human form in the frontal laying position, said body support second side including means for supporting the human head, thorax, pelvis and legs in the frontal laying position, a first pair of spaced fixed feet non-movably attached to the body support for supporting the body support in a fixed position without rocking on a horizontal surface located on one side of a plane generally defining the body support in the back laying or sitting position, and a second pair of spaced fixed feet non-movably attached to the body support for supporting the body support in a fixed position without rocking on a horizontal surface located on the opposite side of a plane generally defining the body support in the frontal laying position whereby the chaise is changed from one mode to the other by rotating the chaise about 150 degrees about a horizontal axis, said body support being invertible from the back laying or sitting position to the frontal laying position.

4. A convertible chaise as defined in claim 3, wherein the body support is unarticulated, and the first pair of feet and the second pair of feet are fixed with respect to the body support and wherein the first pair of feet are spaced from the second pair of feet.

5. A human body lounge convertible from a chair to thoracic pelvic inverted supine support, comprising: a generally arcuate rigid body support having a resilient non-slidable concave chair surface on one side and a resilient non-slidable convex surface on the other side for supporting the human head, thorax, pelvis and legs in a frontal laying position, a first pair of spaced supports permanently and non-movably fixed to and projecting from the body support having ground engaging feet lying in a common first plane for supporting the body support with the concave surface facing upwardly without rocking in a chair position, and a second pair of spaced supports permanently and non-movably fixed to and projecting from the body support having ground engaging feet lying in a common second plane for supporting the body support with the convex surface facing upwardly without rocking in a frontal laying position, said body support being invertible from the back laying or sitting position to the frontal laying position.

6. A human body lounge as defined in claim 5, wherein the first and second planes are angularly spaced apart about 150 degrees.

7. A human body lounge as defined in claim 5, wherein the body support has a head end and a leg end common to both a chair position and said laying position.

8. A human body lounge as defined in claim 5, wherein the resilient concave chair surface and the convex surface are closely spaced and parallel to one another throughout the length of the body support.

9. A human body lounge as defined in claim 5, wherein the body support has a leg support portion common to both the back laying or sitting position and the frontal laying position, said leg support portion having an end spaced from the ground approximately 5 to 10 inches in both positions thereof.

10. A human body lounge as defined in claim 5, wherein the body support has a central support portion that supports the upper human body in both the back laying or sitting position or the frontal laying position, said body support having a head end directly adjacent the central portion spaced from the ground approximately 5 to 10 inches in the frontal laying position and spaced from the ground 25 to 35 inches in the back laying or sitting position.

11. A human body lounge convertible from a chair to thoracic pelvic inverted supine support, comprising: a generally arcuate rigid body support having a resilient concave chair surface on one side and a resilient convex thoracic pelvic surface on the other side, a first pair of spaced supports fixed to and projecting from the body support having ground engaging feet lying in a common first plane for supporting the body support with the concave surface facing upwardly, and a second pair of spaced supports fixed to and projecting from the body support having ground engaging feet lying in a common second plane for supporting the body support with the convex surface facing upwardly without rocking in a frontal laying position, said body support being generally tubular, said first pair of spaced supports including a pair of tubular members extending from one side of the tubular body, said second pair of spaced supports including a second pair of tubular members extending oppositely from the first tubular members that also define arm rests in the chair position.

12. A human body lounge as defined in claim 9, including a third pair of tubular members extending from the tubular body support at one end thereof in the same direction as the second tubular members for supporting the body support in the frontal laying position.

* * * * *